US005517394A

United States Patent [19]

Lin

[11] Patent Number: 5,517,394

[45] Date of Patent: May 14, 1996

[54] DECORATIVE LAMP ASSEMBLY

[76] Inventor: Cheng-Yuan Lin, No. 39, Sec. 3, Chung-Hua Rd., Hsinchu City, Taiwan

[21] Appl. No.: 512,817

[22] Filed: Aug. 9, 1995

Related U.S. Application Data

[63] Continuation-in-part of Ser. No. 310,236, Sep. 21, 1994.

[51] Int. Cl.[6] ..... F21V 11/00

[52] U.S. Cl. ..... 362/353; 362/311; 362/363; 362/806

[58] Field of Search ..... 362/226, 267, 362/311, 353, 363, 375, 806

[56] References Cited

U.S. PATENT DOCUMENTS

| | | | |
|---|---|---|---|
| 2,347,055 | 4/1944 | Johnson | 240/41 |
| 2,481,054 | 9/1949 | Wendel | 240/26 |
| 2,709,217 | 5/1955 | McCluskey | 240/2 |
| 3,248,531 | 4/1966 | Dover | 240/8.3 |
| 3,763,367 | 10/1973 | Nitsch et al. | 362/267 |
| 4,450,511 | 5/1984 | Micha | 362/267 |
| 4,521,836 | 6/1985 | Puttlemanns et al. | 362/145 |
| 5,184,890 | 2/1993 | Chen et al. | 362/353 |
| 5,361,192 | 11/1994 | Lai | 362/226 X |
| 5,414,605 | 5/1995 | Lin | 362/806 X |

*Primary Examiner*—Stephen F. Husar
*Attorney, Agent, or Firm*—Seed and Berry

[57] ABSTRACT

A decorative lamp assembly includes a lamp holder which has a cylindrical seat with an elongated cylindrical wall in which an engaging unit is formed. A lamp is connected securely to the upper end of the cylindrical seat and has two electrical wires extending outwardly through the lower end of the cylindrical seat. A lamp-casing holder has a one-piece hollow body which includes an inner cylindrical wall that is sleeved tightly around the cylindrical seat, and an outer cylindrical wall that is concentric with the inner cylindrical wall to confine with the inner cylindrical wall an annular space for receiving tightly the annular neck portion of a lamp casing when the lamp casing is inserted into the lamp-casing holder. The top end of the inner cylinder wall of the lamp-casing holder has a projection member which engages the engaging unit of the lamp holder in order to prevent the disengagement of the lamp holder from the lamp-casing holder.

8 Claims, 3 Drawing Sheets

DECORATIVE LAMP ASSEMBLY

CROSS-REFERENCE OF RELATED APPLICATION

This invention is a continuation-in-part (CIP) application of U.S. patent application Ser. No. 08/310,236, which was filed on Sep. 21, 1994 pending.

BACKGROUND OF THE INVENTION

1. Field of the Invention

This invention relates to a decorative lamp assembly, more particularly to an improved decorative lamp assembly which is simple in structure and which has parts that are secured firmly to one another.

2. Description of the Related Art

In co-pending U.S. application Ser. No. 08/310,236, the applicant disclosed a decorative lamp assembly which has a simple structure so as to simplify its assembly and to lower the manufacturing cost thereof. The decorative lamp assembly comprises a lamp holder, a lamp-casing holder and a waterproof cap which engage one another only by means of friction forces therebetween.

SUMMARY OF THE INVENTION

Accordingly, the main object of the invention is to provide a decorative lamp assembly in which the engaging forces between the lamp holder and the lamp-casing holder thereof are increased to secure firmly the lamp holder to the lamp-casing holder.

The decorative lamp assembly according to this invention includes a lamp holder which has a substantially cylindrical seat with an upper end, a lower end and an elongated cylindrical wall extending from the upper end to the lower end. The elongated cylindrical wall has an external face which is provided with an engaging means. A lamp is connected securely to the upper end of the cylindrical seat and has two electrical wires extending outwardly through the cylindrical seat. A lamp casing has a bottom access opening and an annular neck portion extending downwardly from the access opening. A lamp-casing holder has a one-piece hollow body which includes an inner cylindrical wall that is sleeved tightly around the cylindrical seat, and an outer cylindrical wall that is concentric with the inner cylindrical wall to confine with the inner cylindrical wall an annular space for receiving tightly the annular neck portion of the lamp casing when the lamp casing covers the lamp. The inner cylindrical wall of the lamp-casing has a top end and an external wall face which has a projection member that extends radially from the external face adjacent to the top end. The projection member engages the engaging means in order to prevent the lamp-casing holder from disengaging from the lamp holder through the upper end of the cylindrical seat.

Preferably, the hollow body of the lamp-casing holder is made of a rubber material.

In a preferred embodiment, the engaging means of the lamp holder includes an annular groove in which the projection member of the lamp-casing holder is retained.

In another preferred embodiment, the engaging means of the lamp holder includes two opposite ribs which extend transversely over the top end of the inner cylindrical wall. Each of the opposite ribs has a lower face which rests on the projection member.

Preferably, the lamp holder has an annular flange extending radially and outwardly from the cylindrical wall of the lamp holder adjacent to the lower end of the cylindrical seat. The bottom end of the inner cylindrical wall rests on the annular flange.

The decorative lamp assembly further comprises a waterproof cap which has a cylindrical wall, a top opening, a bottom wall and an upright post extending upwardly from the bottom wall. The upright post is inserted into the lower end of the cylindrical seat and engages frictionally the electrical wires in order to secure removably the waterproof cap to the lamp holder. The cylindrical wall of the waterproof cap has an external face with two opposed recesses, and the annular flange of the lamp holder has two resilient hooks depending therefrom. Each of the resilient hooks engages a respective one of the recesses so as to retain the waterproof cap in position.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENT

Figure 1:
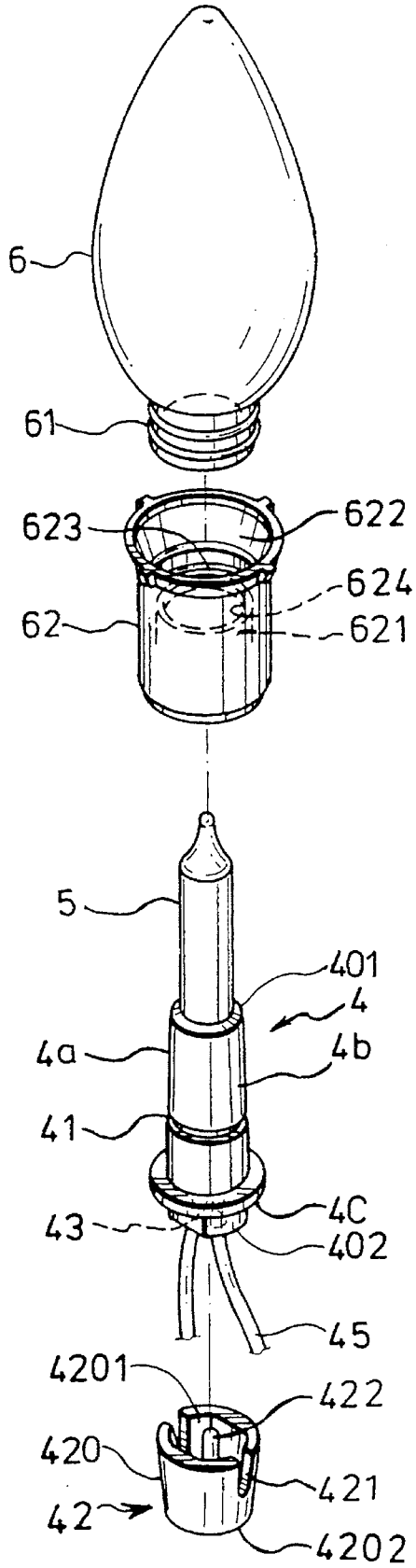
FIG. 1 is an exploded view of a first preferred embodiment of a decorative lamp assembly of this invention.

Before the present invention is disclosed in greater detail, it should be noted that like elements are denoted by the same reference numerals throughout the disclosure.

Figure 2:
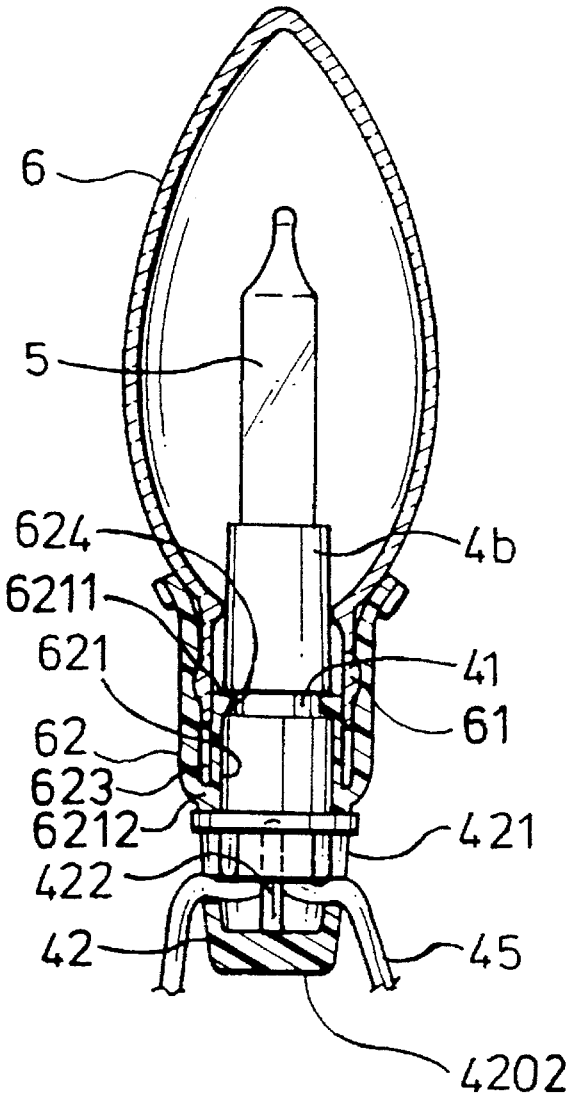
FIG. 2 is a sectional view of the decorative lamp assembly shown in FIG. 1.

Referring to FIGS. 1 and 2, a decorative lamp assembly according to this invention includes a lamp holder 4 which is made of an insulating material. The lamp holder 4 includes a substantially cylindrical seat (*4a*) which has an upper end 401, a lower end 402 and an elongated cylindrical wall (*4b*) tapering from the lower end 402 to the upper end 401. The lamp holder 4 further includes an annular flange (*4c*), which extends radially and outwardly from the cylindrical wall (*4b*) adjacent to the lower end 402 of the cylindrical seat (*4a*), and an engaging means which is in the form of an annular groove 41 that is formed in the external face of the cylindrical wall (*4b*).

A lamp 5 is connected securely to the upper end 401 of the cylindrical seat (*4a*) and has two electrical wires 45 extending outwardly via a hole 43 in the lower end 402 of the cylindrical seat (*4a*). A waterproof cap 42 is attached removably to the lower end 402 of the cylindrical seat (*4a*), and has a cylindrical wall 42, a top opening 4201, a bottom wall 4202 and an upright post 422 extending upwardly from the bottom wall 4202. The upright post 422 is inserted into the lower end 402 of the cylindrical seat (*4a*) and engages frictionally the electrical wires 45 in order to secure removably the waterproof cap 42 to the lamp holder 4. The top opening 4201 is closed by the annular flange (*4c*) of the lamp holder 4. The cylindrical wall 420 of the waterproof cap 42 is formed with two opposite notches 421 for the passage of the electrical wires 45.

A transparent lamp casing 6 has a bottom access opening and an annular neck portion 61 extending downwardly from the access opening. A lamp-casing holder 62, which is made of a rubber material, has a one-piece hollow body which includes an inner cylindrical wall 621 that is sleeved tightly around the lower section of the cylindrical wall (*4b*) of the lamp holder 4, as best illustrated in FIG. 2. The inner cylindrical wall 621 has an annular projection member 624 that extends radially from the external wall face thereof adjacent to the top end 6211 thereof. The projection member 624 engages the annular groove 41 of the lamp holder 4 in order to prevent the lamp-casing holder 62 from disengaging from the lamp holder 4 through the upper end of the cylindrical seat (*4a*). The bottom end 6212 of the inner cylindrical wall 621 may rest on the annular flange (*4c*) when the projection member 624 engages the annular flange (*4c*). Due to the engagement of the projection member 624 and the annular groove 41 and tight engagement of the inner cylindrical wall 621 and the lower section of the cylindrical wall (*4b*) of the lamp holder 4, the lamp holder 4 and the lamp-casing holder 62 can be connected securely to one another.

The one-piece hollow body of the lamp-casing holder 62 further includes an outer cylindrical wall 622 which is concentric with the inner cylindrical wall 621 to confine with the inner cylindrical wall 621 an annular space 623 in order to receive tightly the annular neck portion 61 of the lamp casing 6. The outer cylindrical wall 622 has a lower end extending toward and connected integrally to the lower end 6212 of the inner cylindrical wall 621, and an upper open end extending upwardly of the top end 6211 of the inner cylindrical wall 621.

Figure 3:
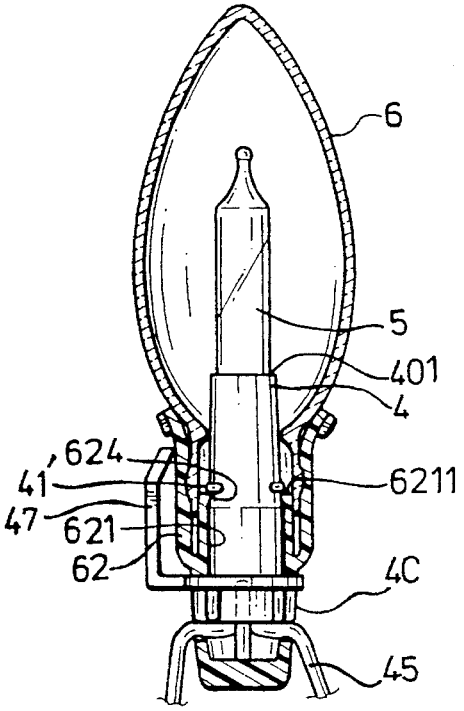
FIG. 3 is a sectional view of a second preferred embodiment of a decorative lamp assembly according to the present invention.

FIG. 3 shows a second preferred embodiment of the decorative lamp assembly of the present invention. In this embodiment, the structure of the decorative lamp assembly is similar to that of the first embodiment except that the engaging means of the lamp holder 4 is in the form of two opposite ribs 41' which extend transversely over the top end 6211 of the inner cylindrical wall 621. Each of the opposite ribs 41' has a lower face which rests on the projection member 624 in order to prevent disengagement of the lamp holder 4 from the lamp-casing holder 62. In addition, an L-shaped hook member 47 is connected to the annular flange (*4c*).

Figure 4:
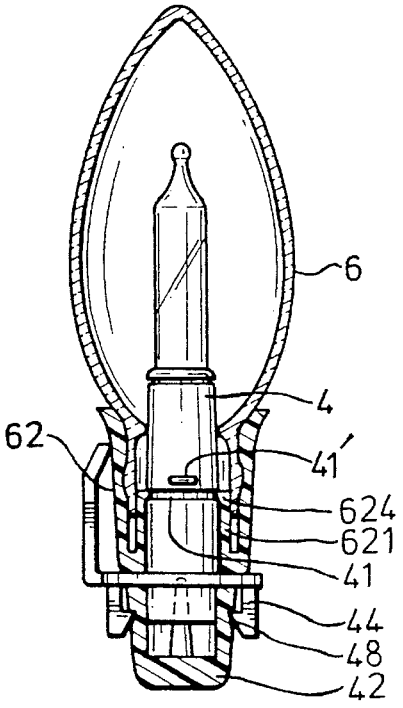
FIG. 4 is a sectional view of a third preferred embodiment of a decorative lamp assembly according to the present invention.

FIG. 4 shows a third preferred embodiment of the decorative lamp assembly of the present invention. In this embodiment, the structure of the decorative lamp assembly is similar to that of the first embodiment except that the two opposite ribs 41' of the second embodiment are provided additionally between the upper end 401 of the cylindrical seat (*4a*) and the top end 6211 of the inner cylindrical wall 621. In addition, the cylindrical wall 420 of the waterproof cap 42 has an external face with two opposed recesses 48, and the annular flange (*4c*) of the lamp holder 4 has two resilient hooks 44 depending therefrom. Each of the resilient hooks 44 engages a respective one of the recesses 48 so as to retain securely the waterproof cap 42 in position.

When used outdoors, the decorative lamp assembly of the present invention is generally hung invertedly with the use of the hook member 47. It is noted that the notches 421 of the waterproof cap 42 are formed in the cylindrical wall of the waterproof cap 42. Thus, the decorative lamp assembly of the present invention can have a good waterproofing effect.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A decorative lamp assembly comprising:

a lamp holder including a substantially cylindrical seat having an upper end, a lower end and an elongated cylindrical wall extending from said upper end to said lower end, said elongated cylindrical wall having an external face which is provided with an engaging means;

a lamp connected securely to said upper end of said cylindrical seat and having two electrical wires extending outwardly through said lower end of said cylindrical seat;

a lamp casing having a bottom access opening and an annular neck portion extending downwardly from said access opening; and a lamp-casing holder having a one-piece hollow body which includes an inner cylindrical wall that is sleeved tightly around said cylindrical seat, and an outer cylindrical wall that is concentric with said inner cylindrical wall to confine with said inner cylindrical wall an annular space for receiving tightly said annular neck portion of said lamp casing when said lamp casing covers said lamp, said inner cylindrical wall of said lamp-casing having a top end and an external wall face which has a projection member that extends radially from said external wall face adjacent to said top end, said projection member engaging said engaging means in order to prevent said lamp-casing holder from disengaging from said lamp holder through said upper end of said cylindrical seat.

2. A decorative lamp assembly as claimed in claim 1, wherein said hollow body of said lamp-casing holder is made of a rubber material.

3. A decorative lamp assembly as claimed in claim 2, wherein said engaging means of said lamp holder includes an annular groove in which said projection member of said lamp-casing holder is retained.

4. A decorative lamp assembly as claimed in claim 2, wherein said engaging means of said lamp holder includes two opposite ribs which extend transversely between said upper end of said cylindrical seat and said top end of said inner cylindrical wall.

5. A decorative lamp assembly as claimed in claim 4, wherein each of said opposite ribs has a lower face which rests on said projection member.

6. A decorative lamp assembly as claimed in claim 1, wherein said lamp holder has an annular flange extending radially and outwardly from said cylindrical wall of said lamp holder adjacent to said lower end of said cylindrical seat, said inner cylindrical wall having a bottom end which rests on said annular flange.

7. A decorative lamp assembly as claimed in claim 6, further comprising a waterproof cap which has a cylindrical wall, a top opening, a bottom wall and an upright post extending upwardly from said bottom wall, said upright post being inserted into said lower end of said cylindrical seat and engaging frictionally said electrical wires in order to secure removably said waterproof cap to said lamp holder, said top opening being closed by said annular flange of said lamp holder, said cylindrical wall of said waterproof cap being formed with two opposite notches for passage of said electrical wires.

8. A decorative lamp assembly as claimed in claim 7, wherein said cylindrical wall of said waterproof cap has an external face with two opposed recesses, and said annular flange of said lamp holder has two resilient hooks depending therefrom, each of said resilient hooks engaging a respective one of said recesses so as to retain said waterproof cap in position.

* * * * *